United States Patent [19]

Wurst et al.

[11] 4,149,476

[45] Apr. 17, 1979

[54] TWIN NEEDLE MEMORY DEVICE

[75] Inventors: John W. Wurst, Dover; William H. Dunn, Branchville, both of N.J.

[73] Assignee: The Singer Company, New York, N.Y.

[21] Appl. No.: 941,812

[22] Filed: Sep. 11, 1978

[51] Int. Cl.[2] ..... D05B 3/02; D05B 1/08

[52] U.S. Cl. ..... 112/158 E; 112/163

[58] Field of Search ..... 112/158 E, 121.11, 121.12, 112/158 R, 163–167

[56] References Cited

U.S. PATENT DOCUMENTS

| | | | |
|---|---|---|---|
| 3,982,491 | 9/1976 | Herzer et al. | 112/121.12 |
| 4,048,932 | 9/1977 | Odermann et al. | 112/158 E |
| 4,055,130 | 10/1977 | Larsen et al. | 112/158 E |

*Primary Examiner*—Peter Nerbun

*Attorney, Agent, or Firm*—Edward P. Schmidt; Robert E. Smith; Edward L. Bell

[57] ABSTRACT

A twin needle memory device for an electronically controlled sewing machine having a variety of patterns and sewing condition capabilities selectable by means of proximity switch devices. A non-volatile external storage having a one bit capability is provided to retain information as to the last state of the sewing machine, relative to twin needle, upon power interruption; and to provide for proportionate reduced amplification of the bight analog signal in the event that the twin needle mode of operation is selected. Upon reinitiation of power, the state of the external storage is ascertained and used to determine the state of a twin needle flip flop part of the electronic control system of the sewing machine. Subsequent change in twin needle condition is implemented through the proximity switch devices and an additional one second delay count to alter the state of the twin needle flip flop. This alteration in the state of the twin needle flip flop will also alter the state of the non-volatile external storage device.

7 Claims, 3 Drawing Figures

TWIN NEEDLE MEMORY DEVICE

DESCRIPTION

BACKGROUND OF THE INVENTION

This invention is in the field of sewing machines, more particularly, it is concerned with a twin needle memory device for an electronically controlled sewing machine having an operator interface through proximity switch devices.

Increasingly, modern day appliances are making use of touch control panels which use touch activated switch means to detect the presence of an operator's finger selecting a capability or condition. This approach is particularly well suited to an electronically controlled sewing machine because of the multiplicity of capabilities and conditions from which a selection may be made simply by the touch of an operator's finger.

However, in the field of zig zag sewing machines, there exists a condition which may be a hazard to an operator if not retained to survive a power shut off. The condition referred to is the twin needle mode of operation wherein, for example, a particularly decorative stitch capability may be effected using two needles with different colored threads. In normal single needle operation, the sewing machine may be capable of, for example, a bight, or lateral movement of the sewing needle, of approximately 6 millimeters. In the twin needle condition or mode of operation, however, two sewing needles are used spaced apart approximately 2½ millimeters. It is apparent that neither needle may undergo 6 millimeter lateral motion without causing the other needle to harpoon the throat plate outside of the normal aperture required to permit passage of the needle to a rotating looptaker beneath the throat plate. If an attempt is made to enlarge the aperture through which the sewing needles extend, the capacity of the rotating looptaker to catch a loop of thread from the sewing needles may be exceeded. Therefore, the only logical choice is to provide means, effective upon the initiation of the twin needle condition, to limit the permissible lateral motion of the sewing needles. In heretofore known electronically controlled sewing machines, this has been accomplished by utilizing a mechanical switch which, in the twin needle position, reduced the amplitude of the signal in proportion to the reduction in swing amplitude, or bight, required for the situation wherein multiple needles are used. The mechanical switch thus utilized remains in the selected position until deliberately moved by an operator in the course of stitching operation on a garment. However, it is apparent that the use of a touch control panel utilizing a plurality of proximity or momentary contact switches and the use of a single mechanical switch to maintain a twin needle condition are not esthetically and functionally compatible.

What is required is a means of attaining a twin needle condition through the use of touch activated switch means, which twin needle status is retained until deliberately changed by an operator. In the event of a power down condition, it is necessary that, upon reinitiation of power, the pre-existing status of twin needle condition be reinstated in order to prevent the possible hazard to an operator and damage resulting from resumption of a full bight condition with a twin needle inserted in the sewing machine.

SUMMARY OF THE INVENTION

The above requirements are met in an electronically controlled sewing machine which uses a non-volatile external storage of one bit in order to retain the status of the twin needle condition prior to power turn off. The non-volatile external storage is most readily implemented by a magnetic latching relay having a stable state for the presence of a twin needle or twin needle on condition, and a stable state for single needle operation. Upon an operator touching of a twin needle condition on a touch control panel of a sewing machine, enable logic ascertains that a valid touch has taken place and thereupon initiates a one second delay count prior to transfer of the signal to a twin needle flip flop. Becuase of the danger of needle breakage from inadvertant operation, the twin needle touch pad must be operated for the additional one second before being accepted as a valid twin needle touch. The state of the twin needle flip flop is gated through to the magnetic latching relay in order to provide a stable storage of the state of the twin needle condition which would survive a power down condition of the sewing machine. When power to the sewing machine is reinitiated, an initial condition logic determines the state of the external storage by means of a first switch internal to and operated by the magnetic latching relay which establishes a bypass to ground for twin needle on condition; or to a positive voltage for single needle condition. A second switch, part of the magnetic latching relay, is provided which, when selectively operational for a twin needle on condition, imposes a fixed limit on the analog signal at the output of an digital to analog converter providing a signal to a servo amplifier for bight control of the sewing machine.

Accordingly, it is an object of this invention to provide a novel and improved bight stop mechanism for an electronically controlled sewing machine having all the inputs thereto provided by a touch control panel.

It is the further object of this invention to provide a novel and improved bight stop mechanism implemented through the touch control panel, which will survive a power down of the sewing machine.

Other objects and advantages of the invention will be best understood when reading the following description with the accompanying drawings as identified below.

DESCRIPTION OF DRAWINGS

Referring now to FIG. 1, there is shown an electronically controlled sewing machine 10 having an on-off switch 12 to interupt power taken by means of a line cord (not shown) from a wall socket in a home. All other operator interface with the sewing machine 10 is by means of a touch control panel 14 upon which indicia of various patterns 16 and conditions 18, 22 are displayed. The conditions 18, 22 displayed on the lower level of the touch control panel 14 are, reading from left to right, reverse stitch for back tack; single pattern usually activated with a pattern 16 in order that a single pattern, such as a single flower, may be implemented; mirror image so that alternate single patterns are mirror images of each other; twice size in order to enable a pattern elongation to twice the normal size; and, twin needle condition in order to accommodate a twin needle in place of a single sewing needle 20 without hazard to an operator or damage to the sewing machine. This invention is concerned with a twin needle condition, more specifically, with a means to retain a memory of a twin needle condition which would survive a power down condition by the on off switch 12, and reinstate that condition upon resumption of power on.

Figure 1:
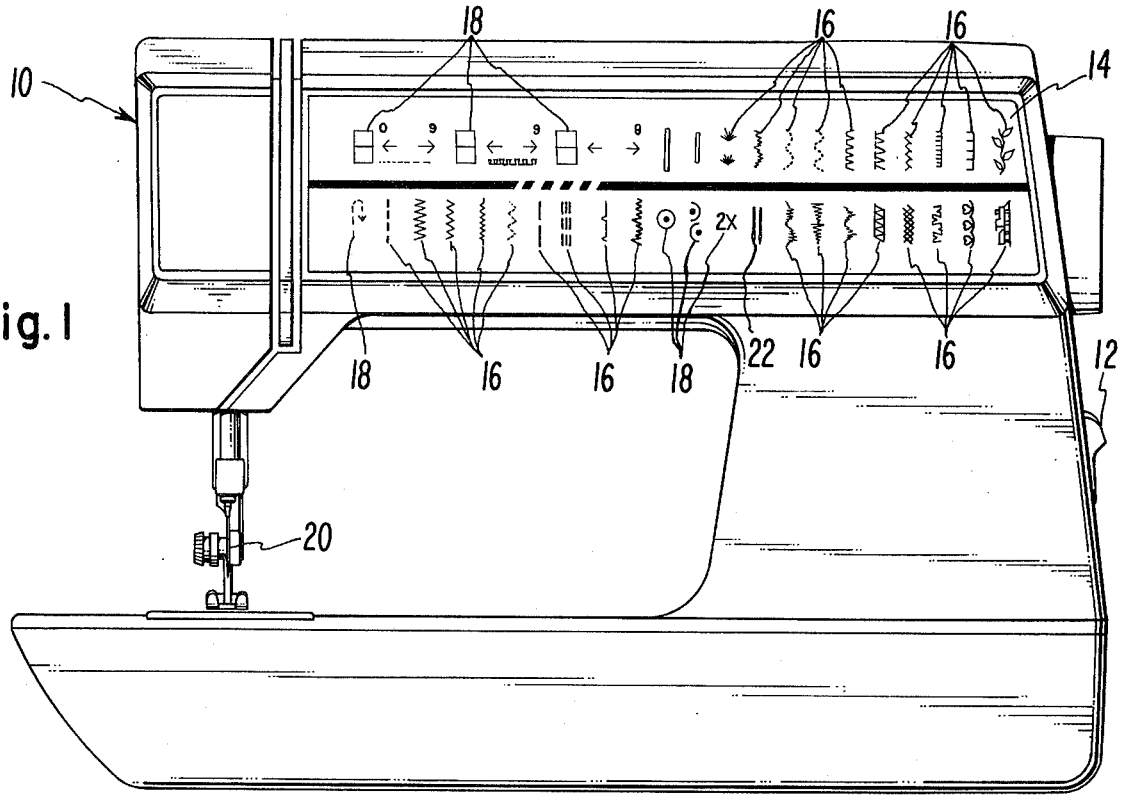
FIG. 1 is an elevational view of an electronically controlled sewing machine having an on-off switch for disconnecting from power and, as the sole other operator inputs thereto, a touch control panel indicating the pattern capabilities and stitch condition parameters for effecting operation thereof.

For those interested in a fuller understanding of an electronically controlled sewing machine, reference may be had to U.S. Pat. No. 4,016,821 issued on, Apr. 12, 1977, and assigned to the assignee as the instant invention, which is hereby incorporated by reference herein. In that patent there is disclosed an electronically controlled sewing machine substantially similar in operation to that of the instant invention, differing primarily in that only certain of the controls use proximity devices. In the sewing machine shown in FIG. 1, each of the patterns 16 and conditions 18 are associated with a pair of proximity devices which are activated by the presence of an operator's finger on a selected indicium of the indicia displayed on touch control panel 14. Electronic means are provided internally of the sewing machine 12 to determine whether a valid selection has been made, to prevent erroneous selection and to decode the valid input thus obtained to a form usable by a large scale integration, referred to as a sewing chip, which contains the proper pattern information. The information is released from the large scale integration, in pulse width modulated form, to a digital to analog converter, and is further processed before being passed on to a servo system which operates a reversible DC motor for positioning a needle bar of the sewing machine or a feed regulator thereof. Logic circuitry and other large scale integration are supplied in order to satisfy the other operating requirements of the sewing machine as selected by an operator.

Figure 2:
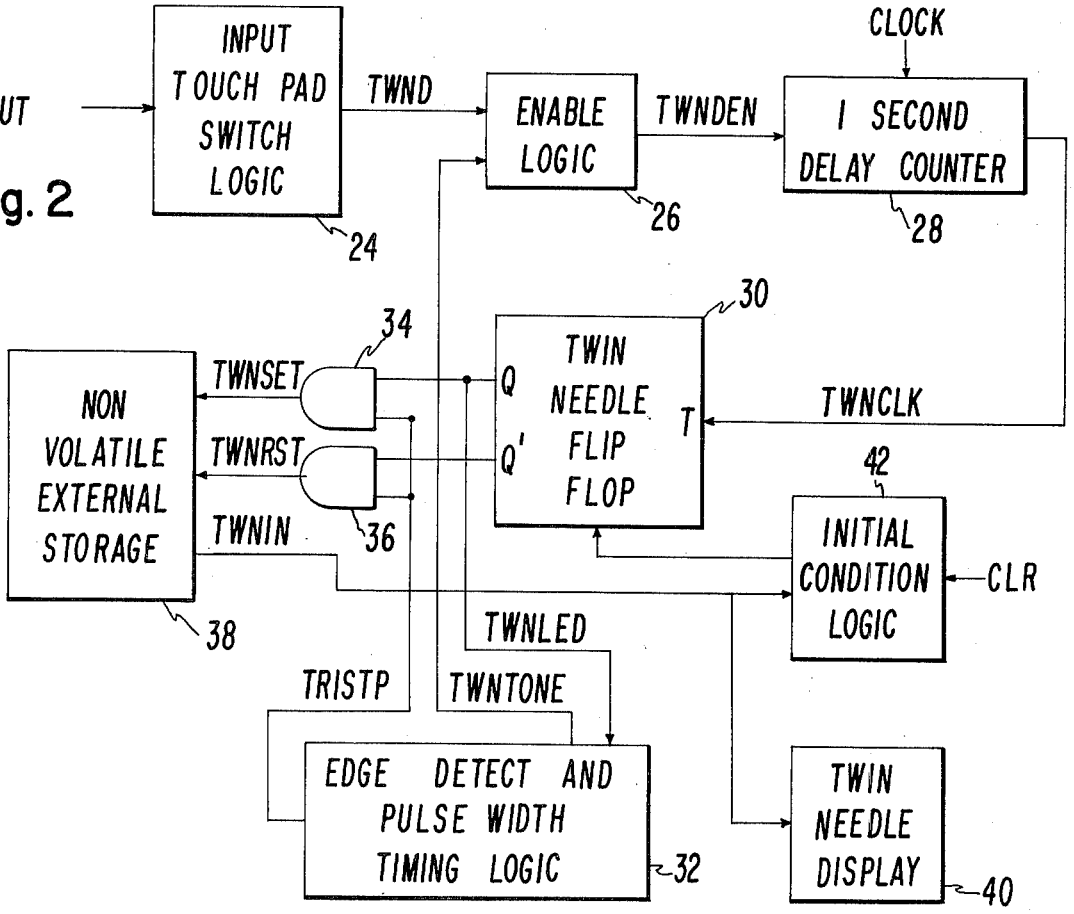
FIG. 2 is a general schematic block diagram for the bright control system of the invention; and, FIG. 3 is a partial circuit diagram showing the bight control circuits of the invention.

Referring now to FIG. 2, there is shown in block diagrammatic form the twin needle memory device of the invention. The input to the input touch pad switch logic block 24 is effected by an operator's touching of the twin needle indicium 22. The input touch pad switch logic 24 outputs a twin needle signal (TWND) to an enable logic block 26 which will enable the selection if the touch panel input remains unchanged for three complete consecutive input scanning cycles. Each of the indicia on the touch control panel 14 is located between a pair of proximity pads, each pair of which is unique for each specific indicium thereon. The proximity pads are continuously scanned in order to detect actuation thereof. Actuation of a specific pair of proximity pads is decoded in the input touch pad switch logic 24 which indicates to the enable logic block 26 a specific selection. The enable logic block 26 determines a valid touch for three consecutive scans, and rejects as an invalid touch a roll over, where an operator's finger passes through an adjacent switch during the selection process, and a wipe where an operator touches a finger across several of the indicia. When a valid touch has been determined, the twin needle selection is enabled (TWNDEN). The twin needle enable signal (TWNDEN) then passes on to a one second delay counter 28 which imposes a further requirement for twin needle actuation that the touch remain valid for an additional second. This additional one second delay is to insure that the imposition or removal of the twin needle condition was deliberate, and is in recognition of the damage which may result from a return to a single needle condition while a twin needle is inserted in place of the single needle 20. The one second delay counter 28 may be any conventional divide by N counter, where N is the frequency of the clock input into the counter. The twin enable signal (TWNDEN) may be utilized to gate the clock signal through the counter 28. The output from the counter 28 is a twin clock signal (TWNCLK) to the trigger terminal of a D type twin needle flip flop 30. The Q terminal of the twin needle flip flop 30 passes a signal (TWNLED) to an edge detect and pulse width timing logic 32. Thus, for every change in the state of the twin needle flip flop 30, the level of the TWNLED signal to the edge detect and pulse width timing logic 32 changes, causing the edge detector portion thereof to output a short pulse (TWNTONE). This TWNTONE pulse is fed to the enable logic 26 so as to prevent continued touching of the twin needle condition indicium 22 from once again triggering the twin needle flip flop 30. The TWNTONE signal is also used to initiate a quarter second tone burst which provides an audible signal to the operator that a twin needle condition change has been made. The quarter second tone burst is obtained from clocked flip flops, from which a one eighth second time out is also obtained. Additionally, the TWNTONE signal is applied to the set input of a Set-Reset flip flop in the edge detect and pulse width timing logic 32, which flip flop is reset by the one eighth second time out. This latter flip flop in the edge detect and pulse with timing logic 32 outputs a TRISTP signal of one eighth second duration to a set gate 34 and a reset gate 36. Depending upon the condition of the Q and Q' output of the twin needle flip flop 30, a signal of one eighth second duration may pass through the set gate 34 (TWNSET) to set a non-volatile external storage 38 for twin needle operation, or through a reset gate 36 (TWNRST) to reset the non-volatile external storage 38 for single needle operation. The changed condition of the non-volatile external storage 38 is detected internally thereof and a signal (TWNIN) is transferred to a twin needle display 40 in order to provide or remove back lighting from the twin needle condition indicium 22 on the touch control panel 14.

In the event that power is removed from the sewing machine 10, by manipulation of the on-off switch 12 for example, the non-volatile external storage 38 remains at the last state in which it has been placed. Upon resumption of power to the sewing machine 10 an intialization signal (CLR) is received by an initial condition logic block 42 which enables the input from the non-volatile storage 38 (TWNIN) to set the current memory state of the storage into the twin needle flip flop 30 by way of a clear or a present terminal of the flip flop. No drive output for the non-volatile storage is initiated at this time. However, after the initial condition has been established, the twin needle condition can be altered as previously explained.

Figure 3:
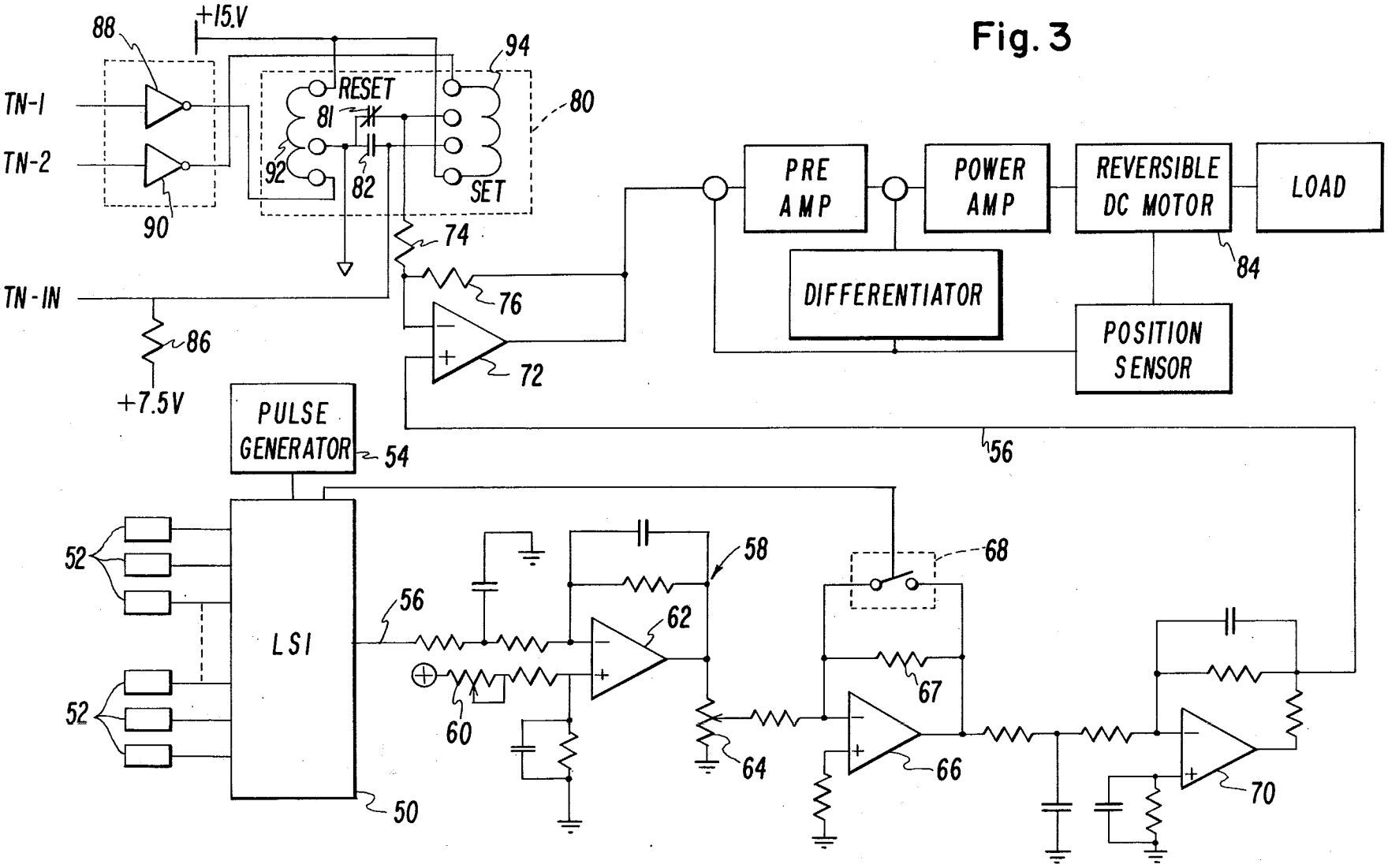

Referring now to FIG. 3 there is shown in partial circuit diagram form the implementation of the non-volatile external storage 38. There is shown a large scale intergration (LSI) 50, which may be implemented by more than one chip, having as inputs thereto signals from proximity pads 52 any two of which will determine which specific pattern 16 or condition 18 has been selected, and a pulse generator 54 operating in timed relation with the sewing machine 10. The pulse generator 54 provides information to the LSI 50 that another stitch cycle has been completed and that certain internal operations are necessary such as, for example, the release of succeeding stitch information from the LSI. Information is released from the LSI 50 via line 56 to the circuitry which determines the needle position of the sewing machine 10. Similar circuitry exists for the feed regulating portion of the sewing machine; however, the twin needle condition requires only adjustment in the bight circuit and therefore only that circuit will be described.

The pulse width modulated signal is presented along line 56 to digital to analog converter 58. The signal is filtered by an RC network, offset by voltage divider 60, amplified in operational amplifier 62 and scaled by rheostat 64. The analog signal from the digital to analog converter 58 passes through a bight signal control amplifier 66 having a feedback circuit including a fixed resistor 67 and a controllable switch 68 connected across the resistor. The switch is selectably controlled by the LSI 50 to short circuit the resistor 67 at a controlled rate to effect a controlled gain reduction for the operational amplifier 66. The output of the bight signal control amplifier 66 then passes through a filtering stage 70 to substantially eliminate the frequency effect of the controlled rate of switching of the switch 68 so that a substantially DC signal is supplied as the output of the filtering stage 70. The output of the filtering stage 70 is applied to the noninverting terminal of a noninverting amplifier 72. The amplification of the noninverting amplifier 72 is a function of the input resistance 74 ($R_I$) and bypass resistance 76 ($R_B$). The inverting terminal for the noninverting amplifier 72 is connected to a normally closed switch 81 of a magnetic latching relay 80. With the switch 81 closed, the inverting terminal of the noninverting amplifier 72 is connected to ground. When the switch 81 is opened the noninverting terminal of the amplifier 72 is left floating and the input resistance thereby becomes extremely large. The formula for the gain of the operational amplifier 72 is as follows:

$$E_o = (1 + \frac{R_B}{R_I}) E_{IN}$$

It will be apparent that when the switch 81 is opened and there is no connection from the inverting terminal of the operational amplifier 72 to ground, the input resistance, as stated above, becomes extremely large and the output voltage ($E_o$) is equal to the input voltage ($E_{IN}$). If the switch 81 is closed, and the input resistance 74 ($R_I$) is equal to the bypass resistance 76 ($R_B$), from the formula, $E_o=(1+1)E_{IN}$ or $E_o=2E_{IN}$. Thus, the state of the switch 81 determines whether a full bight signal will pass on to the servo amplifier system for the reversible DC motor 84 positioning the sewing needle 20 of the sewing machine 10, or whether a half amplitude signal will pass thereto to accommodate the insertion of a twin needle in place of the single sewing needle 20.

the magnetic latching relay 80 includes a second switch 82 which is normally open during operation with a single sewing needle 20. The state of the magnetic latching relay may be determined by a twin-in (TWNIN) signal derived from a +7.5 volt source through a large resistance 86. The resistance 86 is also connected to one side of the switch 82, the opposite side of the switch being connected to ground. Thus, if the magnetic latching relay 80 is set for twin needle operation, the switch 82 is closed, grounding the resistor 86 and the twin-in signal goes low. If, on the other hand, the magnetic latching relay 80 is reset for operation with a single sewing needle 20, the switch 82 is opened and the twin-in signal would go high. Thus, the condition of the magnetic latching relay 80 may be determined by the initial condition logic 42, shown in FIG. 2, in order to re-establish a specific condition for the twin needle flip flop 30.

The magnetic latching relay 80 in FIG. 3 has as inputs thereto twin 1 (TN-1) and twin 2 (TN-2). TN-1 refers to the state of operating with a single sewing needle 20, and corresponds the TWNRST signal of FIG. 2. Thus, when the TN-1 signal is high, it is inverted by inverter 88 to a low and creates a path through the reset coil of the latching relay 80 from the +15 volts. In this state the switch 81 is closed and the switch 82 is opened providing for, as explained above, full bight operation with a single needle and a high TWNIN signal. If the twin-2 (TN-2) signal goes hight, it is inverted by the inverter 90 to a low and a path is created through set coil 94 of the magnetic latching relay 80 to the +15 volts. Setting the magnetic latching relay 80 causes the switch contact 81 to open and the switch contact 82 to close. As explained above, with the switch contact 81 open, the input resistance to the operational amplifier 72 becomes extremely large and the gain of the operational amplifier become one. At the same time the TWNIN signal goes low due to grounding of the resistor 86.

The remaining portion of the circuit shown in FIG. 3 in block diagramatic form pertains to the servo amplifier system for urging the reversible DC motor 84 to positions related to input signals from the LSI 50. This part of the circuit is as described in the above referenced U.S. Pat. No. 4,016,821 and will not be further described herein.

What has been described above is a non-volatile external storage of one bit, implemented by a latching relay, to retain the twin needle status in an electronically controlled sewing machine having an operator interface of a touch control panel. The device of this invention permits the twin needle states to survive a disconnection of power, and provides means for reinitiation of the twin needle state in the sewing machine 12 upon reinitiation of power.

claim:

1. A sewing machine having a frame, a needle bar supported in said frame for endwise reciprocation, said needle bar being adapted for supporting one or more needles for reciprocation therewith, jogging means responsive to electrical input signals for initiating lateral movement of said needle bar to produce a pattern of stitches with the magnitude of the lateral movement of said needle bar being proportional to magnitude of the electrical input signals, pattern control means including first circuit means operative for supplying electrical input signals of predetermined magnitude to said jogging means, said first circuit means including a memory for retaining stitch pattern and operating condition information, touch activated switch means for selecting pattern and operating condition information from said memory, said switch means including the capability for selecting an operating condition of more than one needle supported by said needle bar in order to limit the lateral movement of said needle bar; and means for connecting said sewing machine to a source of electrical power; wherein the improvement comprises:

a non-volatile external storage device responsive to said switch means for selecting an operating condition of more than one needle supported by said needle bar, to retain a record of the actuation thereof which survives a disconnection of said connecting means from said source of electrical power; means by determining the condition of said external storage upon reconnection of said connecting means to said source of electrical power; and, means for reestablishing the operating condition ascertained by said determining means.

2. A sewing machine as claimed in claim 1 wherein said non-volatile external storage device is implemented by a magnetic latching relay, said magnetic latching relay having a set coil for energizing said relay to a first stable condition associated with an operating condition of more than one needle supported by said needle bar, and a reset coil for energizing said relay to a second stable condition associated with an operating condition of one needle supported by said needle bar, said magnetic latching relay being further formed with a first and second pair of contacts, said first pair of contacts being closed during said first stable condition and open during said second stable condition, said second pair of contacts being closed during said second stable condition and open during said first stable conditon.

3. A sewing machine as claimed in claim 2 wherein said determining means includes said first pair of contacts establishing a connection to ground when closed, a resistance connected to said first pair of contacts, and a voltage source connected to said resistance, whereby when said first pair of contacts is closed a low voltage condition exists at the connection between said resistance and said first pair of contacts and when said first pair or contacts is open, a high voltage condition exists at said connection.

4. A sewing machine as claimed in claim 3 wherein said determining means further includes logic means responsive to said low voltage condition at said connection for initiating an appropriate response from said reestablishing means.

5. A sewing machne as claimed in claim 4 wherein said reestablishing means includes a D type flip flop, and wherein said logic means is responsive to said voltage condition at said connection for presetting said flip flop when said voltage condition is low and for clearing said flip flop when said voltage condition is high.

6. A sewing machine as claimed in claim 2 further including second circuit means including said second pair of contacts and operative for limiting said electrical input signals for initiating lateral movement of said needle bar in response to selection of an operating condition of more than one needle supported by said needle bar.

7. A sewing machine as claimed in claim 1 further comprising means associated with said switch means for selecting an operating condition of more than one needle supported by said needle bar for implementing a delay to actuation thereof whereby inadvertent operation thereof is alleviated.

* * * * *

UNITED STATES PATENT OFFICE

CERTIFICATE OF CORRECTION

Patent No. 4,149,476 Dated April 17, 1979

Inventor(s) Wurst et al

It is certified that error appears in the above-identified patent and that said Letters Patent are hereby corrected as shown below:

Column 2, line 15, delete "becuase" and insert -- because --.

Column 6, line 22, delete "hight" and insert -- high --.

Column 6, Claim 1, line 63, after "selecting" insert -- stitch --.

Column 7, Claim 1, line 9, delete "by" and insert -- for --.

Column 8, Claim 5, line 12, delete "machne" and insert -- machine --.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*